US010919308B2

(12) United States Patent
Hitzlsperger

(10) Patent No.: US 10,919,308 B2
(45) Date of Patent: Feb. 16, 2021

(54) SYSTEM AND METHOD FOR SUPPLYING A PRINT HEAD WITH INK

(71) Applicant: Océ Holding B.V., Venlo (NL)

(72) Inventor: Florian Hitzlsperger, Munich (DE)

(73) Assignee: Canon Production Printing Holding B.V., Venlo (NL)

( * ) Notice: Subject to any disclaimer, the term of this patent is extended or adjusted under 35 U.S.C. 154(b) by 16 days.

(21) Appl. No.: 16/405,185

(22) Filed: May 7, 2019

(65) Prior Publication Data

US 2019/0337301 A1 Nov. 7, 2019

(30) Foreign Application Priority Data

May 7, 2018 (DE) ..... 10 2018 110 845

(51) Int. Cl.
*B41J 2/175* (2006.01)

(52) U.S. Cl.
CPC ..... *B41J 2/17596* (2013.01)

(58) Field of Classification Search
CPC ..... B41J 2/17596; B41J 2/17556; B41J 2/17563; B41J 2/175; B41J 2/19
USPC ..... 347/6, 84, 85
See application file for complete search history.

(56) References Cited

U.S. PATENT DOCUMENTS 8,425,017 B2 * 4/2013 Katada ..... B41J 29/38 347/85
2010/0079562 A1 4/2010 Katada et al.
2012/0026256 A1 2/2012 Shibata
2012/0140003 A1 6/2012 Szusdziara et al.

FOREIGN PATENT DOCUMENTS

DE 102010061001 B4 7/2013
DE 202017003026 U1 8/2017

* cited by examiner

*Primary Examiner* — An H Do
(74) *Attorney, Agent, or Firm* — Schiff Hardin LLP

(57) ABSTRACT

A closed supply container that is filled with air and ink is associated with a print head in a one-to-one association. During a printing process, ink is drawn from the supply container into the print head via a connecting line, such that a negative pressure in the supply container is increased. A sensor in the supply container measures the negative pressure and transmits a measurement value to a controller that switches a valve associated with the supply container so that ink is conveyed from an ink storage container into the supply container of the measurement value falls below a predetermined first lower limit value of the pressure such that the fluid pressure in the supply container increases.

18 Claims, 2 Drawing Sheets

SYSTEM AND METHOD FOR SUPPLYING A PRINT HEAD WITH INK

CROSS REFERENCE TO RELATED APPLICATIONS

This patent application claims priority to German Patent Application No. 102018110845.1, filed May 7, 2018, which is incorporated herein by reference in its entirety.

BACKGROUND

Field

The disclosure relates to a system (e.g. an arrangement) and a method for supplying a print head with ink, including for an inkjet printer. A print head and an ink storage container are connected with one another via a supply line. A controller is also provided.

Related Art

Inkjet printers may be used for single-color or multicolor printing to a printing station, for example a single sheet or a recording medium in the form of a web. The design of such inkjet printing systems is described in DE 10 2010 061 001 B4, for example. Inkjet printers that operate according to what is referred to as the Drop-on-Demand (DoD) principle have a print head or a plurality of print heads that have ink channels and nozzle units comprising piezo-actuators, wherein the piezo-actuators controlled by a printer controller may emit ink droplets in the direction of the recording medium. Thermal actuators (bubble jets) may be used as an alternative to piezo-actuators.

The print heads must be supplied with ink during a printing process. For this, a supply arrangement may be provided as described in DE 10 2010 061 001 B4, for example. In this document, a printing unit is described that includes one or more print heads, wherein a plurality of print heads may be connected to form a print bar. Each print head has one or more nozzles via which ink droplets are ejected via generation of a hydraulic pressure.

The supply arrangement may include an ink storage container from which ink is extracted and conveyed into a buffer container with the aid of a pump. With the aid of an additional pump, ink is pumped into an intermediate ink container as needed, wherein the height of the ink level in the intermediate ink container is below the height of the ink level in the print heads. It is thereby achieved that a negative pressure (i.e. a pressure that is below the ambient pressure) is statically created due to the lower position of the intermediate ink container, which is also referred to as a backpressure tank. If ink is ejected from the print heads, the fluid pressure in the backpressure tank drops further. This fluid pressure rises again due to the supply of fresh ink from the ink storage container. Due to the negative pressure, a leaking or outflow of ink from the print head or from the nozzle channel without the operation of an actuator of the print head can be prevented. The adjustment of the negative pressure takes place via the adjustment of the height of the ink level in the intermediate ink container.

The supply of ink to the individual print heads takes place via a single intermediate ink container. The supply arrangement for conveying the ink includes a network of pipes and/or a network of hoses that is composed of rigid pipes and/or flexible hoses. During printing, unwanted pressure fluctuations in the supply arrangement, in particular given long pipes and/or hoses, may arise due to flow resistances and other influences. Flow resistances and long pipes and/or hoses also lead to pressure fluctuations. Moreover, the print heads, which are connected with one another via the network of pipes or network of hoses of the supply arrangement, mutually influence one another, such that unwanted large fluctuations in pressure occur in the print heads that may lead to printing errors and are visible in a generated print image. A pressure regulation over the large volume of the backpressure tank is also relatively difficult to realize.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
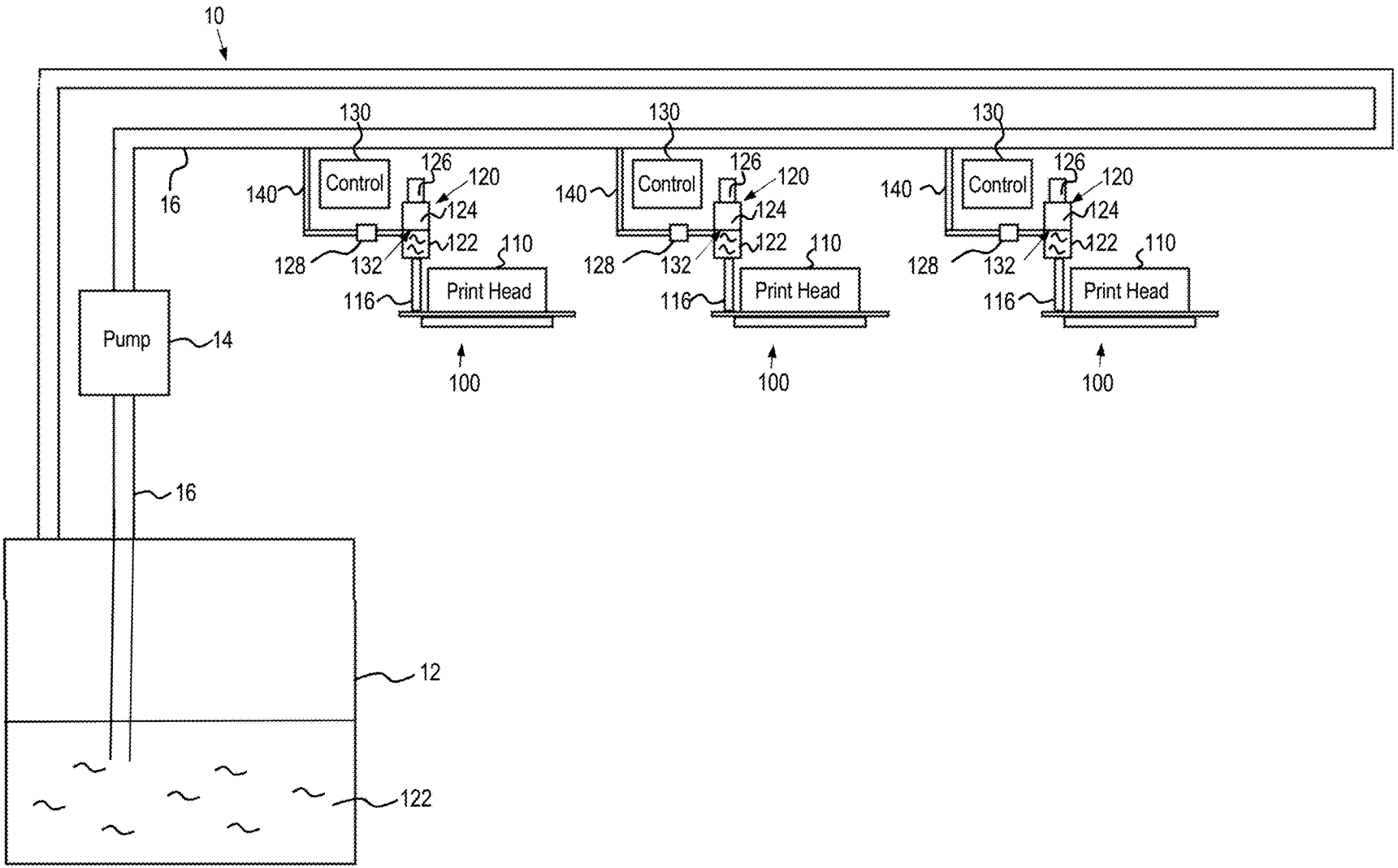
FIG. 1 illustrates system for supplying three print heads with ink according to an exemplary embodiment of the present disclosure.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the disclosure is to provide a system, such as an arrangement, and a method for supplying a print head with ink, given which pressure fluctuations at the print head may be reduced or avoided in a simple and reliable manner.

The arrangement according to an exemplary embodiment of the disclosure includes a print head and an optimally small supply container, associated with the print head, in a one-to-one association, that is arranged optimally close to said print head. The supply container is a closed container that may be sealed air-tight. The supply container and the print head are in particular connected with one another via a connecting line such that a transport of ink during a printing process takes place from the supply container into the print head, wherein a negative pressure is increased via the transport of the ink into the supply container.

In an exemplary embodiment, a sensor is also provided that is configured to measure the fluid pressure in the supply container and transmit the measured value to a controller. The sensor is arranged in an air volume of the supply container. Since the system is closed, the sensor may measure the negative pressure of the ink via the air pressure. In an exemplary embodiment, the controller is configured to control a control element of a supply line, where the control element is associated with the supply container, such that ink from an ink storage container arrives in the supply container via the supply line if the measured value of the sensor falls below a predetermined first limit value. In this example, the fluid pressure in the supply container increases again via the supply of the ink into the supply container. The inflow of ink is stopped if a predetermined second limit value is reached.

According to exemplary embodiments, pressure fluctuations in the print head are advantageously minimized (or reduced). In an exemplary embodiment, a precise monitoring of the pressure ratios is performed for each print head. Furthermore, the possibility of adjusting the pressure ratios thereby exists for each individual print head in order to achieve a high quality of the printed print images.

In an exemplary embodiment, because the negative pressure in the print head is adjusted via a regulated supply of ink, the adjustment of the height of the ink level in a backpressure tank may be omitted. As a result, the backpressure tank may also be advantageously omitted, whereby more degrees of freedom result for the design. In particular, the installation space for the backpressure tank may be saved, and the line network may be simplified. Embodiments of the present disclosure may also be directed to systems in which supply arrangements already exist and include a backpressure tank that can be retrofitted with arrangements according to the teachings of the disclosure. Advantages of the disclosure, namely the prevention of unwanted pressure differences and unwanted pressure fluctuations in the print heads, may also be achieved given such a retrofitting.

In exemplary embodiments where the supply container is arranged as close as possible to the print head, in contrast to arrangements with long lines, no or only slight pressure losses arise. Advantageously, the necessary negative pressure is directly regulated at the print head and therefore is applied precisely at the print head. In an exemplary embodiment, a control element, such as a valve, is associated with each supply container. In an exemplary embodiment, the control element is activated (e.g. by the controller) independently of the control elements of other supply containers. Advantageously, the print heads do not mutually influence one another, such that unwanted high pressure fluctuations in the print heads are also avoided.

In an exemplary embodiment, the supply container according to the disclosure also serves as a refillable damper, because the supply container is interposed between the storage container and the print head and may damp pressure fluctuations caused in the print heads by high ink consumption. This damping is effected via the air volume in the supply container.

The fluid pressure in the print heads is also simply adjusted and/or regulated via the negative pressure in the supply container, depending on the print head, so that different negative pressure values may also be present within a print bar comprising multiple print heads. The value of the negative pressure may also be preset depending on pressure load.

FIG. 1 shows a schematic depiction of a system (e.g. an arrangement) 10 for supplying three printing units 100 with ink according to an exemplary embodiment of the present disclosure. In an exemplary embodiment, each printing unit 100 includes a print head 110, a supply container 120, a supply line 116, a valve 116, and a controller 130. In an exemplary embodiment, the printing units 100 are of identical design, such that only one printing unit 100 is described in detail in the following with reference to FIGS. 1 and 2. Elements having the same function or the same design have the same reference characters. In an exemplary embodiment, in addition to the printing units 100, the system 10 includes an ink storage container 12 that stores ink 122, and a pump 14. With the aid of the pump 14, the ink 122 is pumped from the ink storage container 12 into a supply line 16. In an exemplary embodiment, the supply line 16 is a ring conduit and, with the ink storage container 12, forms a circuit, where the ink 122 in the supply line 16 has a minimum pressure at least in a region of the printing units 100.

In an exemplary embodiment, the supply container 120 is filled with ink 122 and air 124. The ink 122 defines an ink volume, the air 124 an air volume. The ink 122 and the air 124 may be separated from one another by a flexible membrane 132. The flexible membrane 132 prevents the ink 122 in the supply container 120 from drying out, wherein a pressure compensation takes place across the membrane, such that the ink 122 and the air 124 exhibit the same fluid pressure. The membrane 132 also prevents air 124 from being incorporated into the ink 122 via contact of the ink 122 with air 124. The membrane 132 additionally prevents a sensor 126 that is arranged in the air volume of the supply container 120 from coming into contact with ink 122.

One supply container 120 is associated in a one-to-one relationship per each print head 110, and is thereby arranged as close as possible to the print head 110. The supply container 120 is connected with the print head 110 via a short connecting line 116. In an exemplary embodiment, the line length of the connecting line 116 is significantly smaller than the large length of the supply line 16 between print head 110 and ink storage container 12. In an exemplary embodiment, the supply container 120 is closed and air-tight. In an exemplary embodiment, if ink 122 is ejected from the print head 110 in the form of an ink droplet, the same quantity of ink 122 is drawn from the supply container 120.

In an exemplary embodiment, in that the supply container 120 is a closed container, a negative pressure in the supply container 120 increases due to the extraction of ink 122. The more ink 122 that is transported from the supply container 120 into the print head 110 during the printing operation, the more that the fluid pressure in the supply container 120 decreases. In an exemplary embodiment, to adjust and/or regulate the pressure in the supply container 120, a sensor 126 is provided that is configured to sense a pressure to determine a measurement value of the pressure in the supply container 120, and to transmit the measurement value to the controller 130, which is configured to activate a control element 128, such as a valve or actuator, depending on the transmitted measurement value. This control is explained in detail in the following. In an exemplary embodiment, the sensor 126 includes processor circuitry that is configured to perform one or more functions and/or operations of the sensor 126, such as sensing a pressure value and generating a corresponding signal.

If the negative pressure measured with the aid of the sensor 126 falls below a first limit (threshold) value, the controller 130 is configured to activate valve 128 (e.g. a control valve or a solenoid valve) such that ink 122 from the supply line 16 is provided into the supply container 120 via a branch line 140. The controller is configured to control the inflow of the ink 122 from the supply line 16 into the supply container 120 such that the ink 122 is stopped as soon as the pressure value measured by the sensor 126 exceeds a second limit (threshold) value. In an exemplary embodiment, the controller 130 includes processor circuitry that is configured to perform one or more functions and/or operations of the controller 130, such as activating the valve 128.

Figure 2:
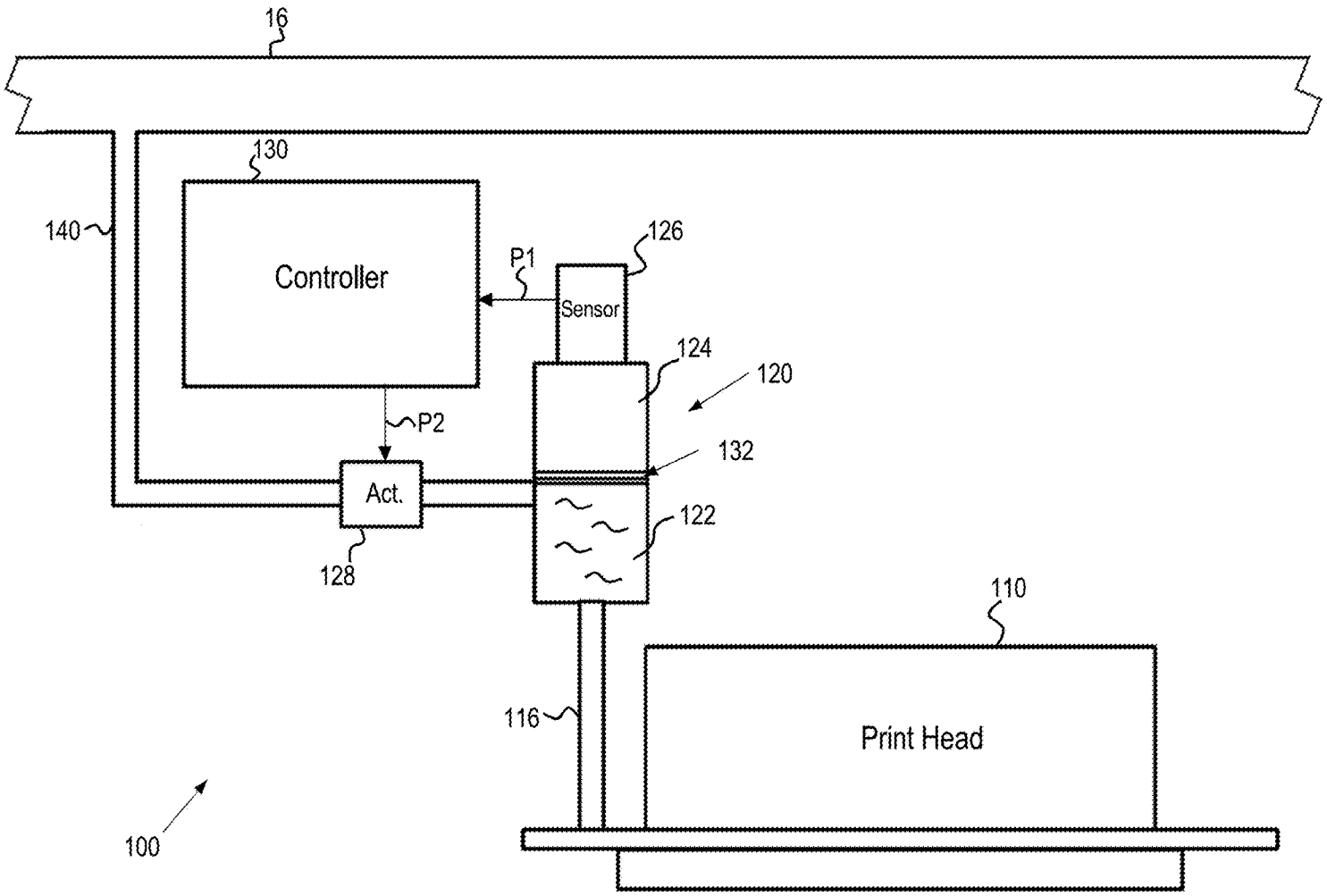
FIG. 2 is an enlarged view of a printing unit of FIG. 1.

FIG. 2 shows a schematic illustration of the printing unit 100 of FIG. 1. The arrow P1 shows the communication connection between the sensor 126 and the controller 130. The arrow P2 shows the communication connection of the controller 130 with the valve 128. In an exemplary embodiment, the sensor 126 transmits a signal corresponding to the measurement value, or data corresponding to the measurement value, to the controller 130. The controller 130 checks whether the measurement value falls below the limit value. If it falls below this limit value, the controller 130 activates the valve 128 such that ink 122 arrives in the supply container 120. The supply of the ink 122 continues until the measurement value of the pressure in the supply container 120 reaches a second limit value. The communication paths P1 and P2 can be multidirectional in one or more embodiments such that the controller 130 can additional transmit data/information to the sensor 126 and/or receive data/information from the valve 128.

In an additional advantageous embodiment, only one central controller may also be provided that individually activates the valves 128 of two or more (e.g. all) of the printing units 100. In an exemplary embodiment, a routine or sub-routine for the respective valve 128 may be provided in the controller 130.

In other embodiments, a plurality of printing units 100 that are arranged at line width in a print bar, transversal to the transport direction of the recording medium, are controlled by a single controller.

In a further embodiment, instead of the ring conduit 16, a respective supply line may be provided from the ink storage container 12 to each print head 110 or to each print bar. Alternatively, a common supply line for all print heads 110 or print bars in which no return of the ink 122 into the ink storage container 12 takes place may be provided instead of the ring line 16.

In a further advantageous embodiment, the controller 130 is configured to evaluate additional information of the system 10, including, for example, the temperature of the ink 122. A temperature sensor may thereby be arranged in the ink storage container 12 that is configured to determine a measurement value of the temperature of the ink in the ink storage container 12 and transmits it to controller 130. In an exemplary embodiment, the controller 130 is configured to control a heating device (not shown) to heat the ink 122 in the ink storage container 122 depending on the determined measurement value.

In a further advantageous embodiment, in addition to the first limit value and the second limit value, a third limit value of the pressure in the supply container 120 may be provided. In an exemplary embodiment, the third limit value is provided to detect an excessive fluid pressure in the supply container 120. If this third limit value is reached by the measurement value determined with the aid of the sensor 126, the controller 130 is configured to output an error message and/or triggers the deactivation of the printing unit 100.

In an advantageous embodiment, a fourth limit value of the pressure in the supply container 120 may also be provided. This is in particular achieved if the ink level falls below a predetermined height. If this fourth limit value is reached by the measurement value determined with the aid of the sensor 126, the controller 130 outputs an error message and/or triggers the deactivation of the printing unit 100, since the danger exists that air 124 arrives into the print head 110.

In an embodiment, the system 10 includes the ink storage container 12, the supply container 120, a backpressure tank, and an intermediate container between the ink storage container 12 and the backpressure tank and a distribution tank.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, other structural electronic hardware, or a combination thereof. A processor includes a microprocessor, a digital signal processor (DSP), central processing unit (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

10 system (e.g. arrangement)
12 ink storage container
14 pump
16 supply line
100 printing unit
110 print head
116 connecting line
120 supply container
122 ink
124 air
126 sensor
128 control element (e.g. valve or actuator)
130 controller
132 membrane
140 branch line

The invention claimed is:

1. A system including an ink storage container for supplying ink to at least two print heads, each of the at least two print heads comprising:

a closed supply container configured to be filled with air and ink;

at least one supply line configured to supply the closed supply container with ink from the ink storage container of the system;

a sensor associated with the closed supply container, and configured to measure pressure in the closed supply container and generate a measure value corresponding to the measured pressure;

a connecting line between a respective one of the at least two print heads and the closed supply container associated with the respective one of the at least two print heads;

a control element between the at least one supply line and the closed supply container; and a controller configured to evaluate the measurement value of the pressure in the closed supply container, and activate the control element associated with the closed supply container based on the measurement value to selectively convey ink into the closed supply container from the ink storage container.

2. The system according to claim 1, further comprising an elastic membrane arranged in a boundary between the ink and the air in the closed supply container.

3. The system according to claim 2, wherein the sensor is located within the air in the closed supply chamber and separated from the ink by the elastic membrane.

4. The system according to claim 1, wherein the control element is a valve.

5. The system according to claim 1, wherein the at least two print heads are of an inkjet printer.

6. The system according to claim 1, wherein the controller is configured to selectively convey the ink into the closed supply container to provide a same quantity of ink from the ink storage container to the closed supply container as is provided from the closed supply container to the respective one of the at least two print heads.

7. The system according to claim 1, wherein the sensor is configured to measure an air pressure of the air in the closed supply container, the measure value corresponding to the measured air pressure.

8. The system according to claim 7, wherein the air pressure is a negative pressure within the closed supply container.

9. The system according to claim 1, wherein the sensor is located within the air in the closed supply chamber.

10. A system for supplying ink to one or more print heads, comprising:

a closed supply container configured to be filled with air and ink;

at least one supply line configured to supply the closed supply container with ink from an ink storage container of the system;

a sensor associated with the closed supply container, and configured to measure pressure in the closed supply container and generate a measure value corresponding to the measured pressure;

a connecting line between a print head of the one or more print heads and the closed supply container that is exclusively associated with the print head of the one or more print heads;

a control element between the at least one supply line and the closed supply container; and a controller configured to evaluate the measurement value of the pressure in the closed supply container, and activate the control element associated with the closed supply container based on the measurement value to selectively convey ink into the closed supply container from the ink storage container.

11. A method for supplying ink to at least two print heads, comprising:

providing ink to a closed supply container via a supply line from an ink storage container, wherein the closed supply container is exclusively associated with one print head of the at least two print heads, the closed supply container being filled with air and the ink;

during a printing process, supplying ink from the closed supply container to the one print head of the at least two print heads via a respective connecting line, wherein a negative pressure in the respective closed supply container increases during the printing process;

determining a measurement value of pressure in the respective closed supply container using a respective sensor and transmitting the determined measurement value to a controller; and activating a control element associated with the respective closed supply container by the controller such that ink is conveyed from the supply line into the closed supply container if the measurement value of the sensor is less than a predetermined first limit value, wherein the pressure in the closed supply container increases via the supply of the ink into the closed supply container.

12. The method according to claim 11, wherein an inflow of ink into the respective closed supply container is stopped if a predetermined second limit value is reached.

13. The method according to claim 11, wherein at least one predetermined third limit value is provided, the controller generating an error message and/or stops the inflow of ink into the respective closed supply container if the measurement value reaches and/or exceeds the predetermined third limit value.

14. The method according to claim 13, wherein at least one fourth limit value is provided, the controller generating an error message and/or triggers deactivation of the respective one of the at least two print heads if the measurement value reaches and/or falls below the predetermined fourth limit value, to prevent air from arriving into the respective one of that least two print heads.

15. The method according to claim 11, wherein at least one fourth limit value is provided, the controller generating an error message and/or triggers deactivation of the respective one of the at least two print heads if the measurement value reaches and/or falls below the predetermined fourth limit value, to prevent air from arriving into the respective one of that least two print heads.

16. The method according to claim 11, wherein the control element is a valve.

17. The method according to claim 11, wherein the at least two print heads are of an inkjet printer.

18. A non-transitory computer-readable storage medium with an executable program stored thereon, wherein, when executed, the program instructs a processor to perform the method of claim 11.

* * * * *